United States Patent [19]

Suzuki et al.

[11] 4,243,382

[45] Jan. 6, 1981

[54] MATERIAL DISTRIBUTING MEANS FOR ROTARY DRUM TYPE HEAT TREATMENT APPARATUS

[75] Inventors: Takeshi Suzuki; Mikio Murao; Masahiro Uchida; Minoru Nezuka, all of Kobe, Japan

[73] Assignee: Kawasaki Jukogyo Kabushiki Kaisha, Kobe, Japan

[21] Appl. No.: 10,799

[22] Filed: Feb. 9, 1979

[30] Foreign Application Priority Data

Feb. 10, 1978 [JP] Japan ..... 53/14672

[51] Int. Cl.[3] ..... F27D 15/02

[52] U.S. Cl. ..... 432/78; 432/80; 222/41; 239/689; 414/216; 414/149

[58] Field of Search ..... 432/77, 78, 80, 106; 34/20, 62; 222/411; 239/681, 689, 231, 522; 414/210, 216, 149

[56] References Cited

U.S. PATENT DOCUMENTS

| | | | |
|---|---|---|---|
| 1,902,517 | 3/1933 | Newhouse | 432/80 |
| 3,350,077 | 10/1967 | Christensen | 432/80 |
| 3,358,977 | 12/1967 | Jensen | 432/80 |
| 3,703,993 | 11/1972 | Schreiner | 239/231 |
| 3,704,873 | 12/1972 | Jensen | 432/80 |
| 4,000,853 | 1/1977 | Drori | 239/231 |
| 4,123,850 | 11/1978 | Niems | 432/78 |

FOREIGN PATENT DOCUMENTS

| | | | |
|---|---|---|---|
| 43-16540 | 7/1968 | Japan | 432/80 |

*Primary Examiner*—Henry C. Yuen
*Attorney, Agent, or Firm*—Fleit & Jacobson

[57] ABSTRACT

Rotary drum type heat treatment apparatus having a rotary drum rotatable about a longitudinal axis. The drum has an outlet end and the apparatus includes a cooling section having a movable grate with one end disposed beneath the outlet end of the rotary drum for receiving material from the drum. The drum is provided at the outlet end with a plurality of circumferentially spaced distribution members, each of which has at least one side surface extending longitudinally outwardly beyond the outlet end and inclined with respect to a radial line of the drum for engagement with material being discharged through the outlet end to deflect the same.

7 Claims, 20 Drawing Figures

MATERIAL DISTRIBUTING MEANS FOR ROTARY DRUM TYPE HEAT TREATMENT APPARATUS

The present invention relates to rotary drum type heat treatment apparatus such as rotary kilns and more particularly to outlet arrangement for such heat treatment apparatus.

Conventionally, a rotary drum type heat treatment apparatus such as a cement clinker burning apparatus includes a rotary kiln and cooling means including a cooling grate which is adapted to receive burned cement clinker particles from the kiln. The particles are 1300 to 1400° C. when they are discharged from the kiln and transported by the grate structure to the outlet portion of the cooling means. While the particles are being transported by the grate structure, they are cooled by cooling air blown upwardly through the grate and the particle bed formed thereon so that the temperature of the particle is decreased normally to 80° C. to 100° C.

In conventional burning apparatus of this type, burned clinker particles are discharged from the outlet end of the kiln to the cooling grate in such a manner that the particles form a bed which is thick at the transversely central portion and gradually decreased in thickness toward the opposite side portions thereof. Thus, there has been a tendency that the cooling air is passed mostly through the side portions of the bed where the bed thickness is decreased and the flow resistance is accordingly small so that the particles in the transversely central portion are not adequately cooled.

In order to eliminate the above problem, there has been proposed to close, at the inlet portion of the cooling means, the grate openings in the opposite side portions so that the effective grate width is decreased at the inlet portion of the cooling means and gradually increased from the inlet portion toward the direction of the transportation of the particles. The proposed arrangement is, however, apparently disadvantageous in that the effective cooling air is decreased.

Another problem encountered in the rotary drum type burning apparatus is caused by the fact that, in case of a material such as cement clinker, there is a very wide range of distribution of particle size. In fact, such cement clinker includes on one hand fine powders smaller than 1 $^{mm}$ and on the other hand large lumps which are as large as 1000 $^{mm}$ in some occasions. In case of such a material, there is a tendency that the fine particles are blown toward the side portions of the grate leaving large particles in the central portion. The flow resistance of the cooling air is therefore increased at the side portions of the grate structure resulting in an inadequate cooling of the particles and sometimes causing a so-called flushing condition wherein red-hot particles flow at a relatively high speed to form so-called red belts. Under such flushing condition, the particles in the red belts are not satisfactorily cooled by the cooling air. Further, the grate structure is subjected at the side portions to serious heat conditions so that the burning apparatus cannot be operated continuously for a prolonged time in order to avoid damages of the grate. It should also be noted that the grate structure must be made of an expensive heat resistance material at least at the opposite side portions thereof since the red belts extend substantially throughout the length of the cooling means.

Where the material has a wide range of distribution of particle size, large particles are apt to be accumulated at the transversely central portion of the grate so that a larger amount of air is passed through the central portion where the flow resistance is relatively small. Therefore, the efficiency of heat exchange between the cooling air and the particles is decreased accordingly. Since the cooling air is directed, after heat exchange with the particles, to the burner of the kiln as the secondary air therefor and also to a calciner associated with a suspension preheater, the decrease in the heat exchange efficiency causes a corresponding decrease in the overall thermal efficiency of the burning apparatus.

In order to solve the aforementioned problems, there has already been proposed to provide beneath the outlet end of the rotary kiln a swingable distribution plate which is driven to move or swing in the transverse direction of the cooling means. The burned particles discharged from the outlet of the kiln fall on the distribution plate and are distributed thereby on the grate structure to form a bed of uniform thickness and uniform particle size distribution. The arrangement is however considered disadvantageous in that it requires a driving mechanism of a substantial capacity, and that the distribution plate is subjected to large impact loads applied by the clinker material so that it is rapidly worn. Further, the plate is used under a serious thermal condition and deposits of clinker material are often formed on the plate. In view of the above disadvantages, it has been found that the proposal is not effective for practical use.

In Japanese patent publication Sho No. 43-16540 and the U.S. Pat. No. 3,350,077, there is taught to use a rotary kiln having an outlet end portion formed with circumferentially spaced radial outlet openings which may or may not be associated with discharge pipes. There is described that in this proposed arrangement the clinker material is discharged through a plurality of outlet openings so that the material is transversely distributed. However, the arrangement is not so advantageous in that the outlet openings may easily be clogged by the material.

It is therefore a primary object of the present invention to provide a rotary drum type apparatus wherein material can be distributed in the widthwise direction with a uniform size distribution and a uniform amount.

Another object of the present invention is to provide an apparatus including a rotary drum which has an outlet end provided with means for ensuring uniform widthwise distribution of material discharged through the outlet end.

A further object of the present invention is to provide a rotary drum type apparatus wherein the outlet end of the rotary drum is free from the problem of clogging.

According to the present invention, the above and other objects can be accomplished by a rotary drum type heat treatment apparatus comprising a rotary drum rotatable about a longitudinal axis and having an outlet end and a cooling section including grate means having one end disposed beneath the outlet end of the rotary drum for receiving material from the drum, said drum being provided at the outlet end with a plurality of circumferentially spaced distribution members, each of said distribution members having at least one side surface which is extending longitudinally outwardly beyond the outlet end and inclined with respect to a radial line of the drum for engagement with the material being discharged through the outlet end to deflect the same.

In a preferable arrangement, the distribution member has at least a pair of side surfaces disposed at the opposite sides of a radial plane of the drum and extending longitudinally outwardly beyond the outlet end for engagement with the material being discharged through the outlet for deflecting the material toward side portions of the grate means. In a preferable aspect of the present invention, the distribution member has a crest defined by a junction of the side surfaces and located radially inwardly of the drum with respect to the side surfaces, said side surfaces being inclined with respect to a radial plane of the drum passing through the crest to define angles therewith. The angle as defined by one of the side surfaces that is located at leading side of the radial plane as seen in the direction of rotation of the drum is preferably smaller than that defined by the other side surface.

According to the features of the present invention, the distribution members function to deflect the material toward the opposite side portions of the grate while the material discharged through the outlet without significant influence of the distribution members is apt to be accumulated on the grate with the larger at the central portion greater in thickness than those at the side portions. Thus, as the result, the bed layer of the material on the grate has a substantially uniform thickness throughout the width of the grate. It is preferable that the distribution members are mounted on the rotary drum for swinging movement about axes parallel with the longitudinal axis of the drum.

The above and other objects and features of the present invention will become apparent from the following descriptions of preferred embodiments taking reference to the accompanying drawings, in which.

Figure 1:
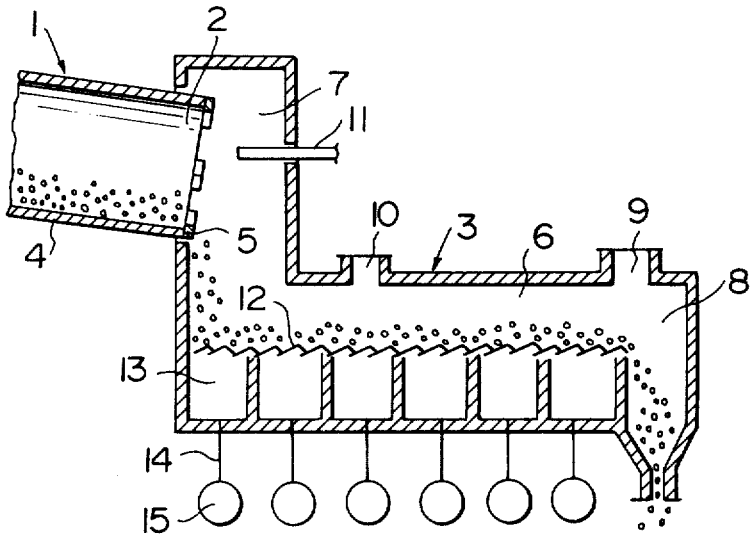
FIG. 1 is a vertical sectional view of a rotary kiln type cement clinker burning apparatus embodying the feature of the present invention.

Referring now to the drawings, particularly to FIG. 1, there is shown a cement clinker burning apparatus embodying the features of the present invention. The apparatus includes a rotary kiln 1 having an oultet end 2 which is connected with a cooling section 3. The kiln 1 is comprised of a cylindrical kiln body 4 which is rotatable about the longitudinal axis thereof and inclined in such a manner that the outlet end 2 is lower than the other end.

The cooling section 3 is basically comprised of a horizontally extending transferring and cooling chamber 6 and an inlet section 7 provided at the inlet end of the chamber 6 and extending upwardly thereform. The cooling chamber 6 and the inlet section 7 are of rectangular cross-sectional configurations and so arranged that burned cement clinker is discharged from the rotary kiln 1 to the inlet section 7 and then received by the cooling chamber 6. At the outlet end of the chamber 6, there is provided an outlet section 8 which is of a rectangular cross-section and extending vertically downwardly. The cooling chamber 6 is further provided with an air exhaust port 9 and an air bleeding port 10.

The outlet end 2 of the kiln 1 is positioned in such a manner that it projects into the inlet section 7 at the upper portion thereof. At the opposite side of the inlet section 7, there is provided a burner 11 which is directed toward the outlet end 2 of the kiln 1. In the cooling chamber 6, there is provided a grate structure 12 which extends horizontally and longitudinally of the chamber 6. A plurality of air chambers 13 are formed beneath the grate structure 12 and connected respectively through conduits 14 with blowers 15. The air bleeding port 10 may be connected with facilities such as a suspension preheater.

The cement clinker in particle form is burned in the rotating kiln 1 at a temperature of 1300° to 1400° C. and discharged through the outlet end 2 and the inlet section 7 into the cooling chamber 6 to be received by the grate structure 12. The clinker on the grate structure 12 forms a bed and transported toward the outlet section 8. The cooling air from the blowers 15 is passed through the grate structure 12 and the clinker bed thereon to the cooling chamber 6 fluidizing and cooling the clinker particles in the bed. The air in the chamber 6 is then passed either to the body 4 of the kiln 1, the exhaust port 9 or the air bleed port 10.

Figure 2:
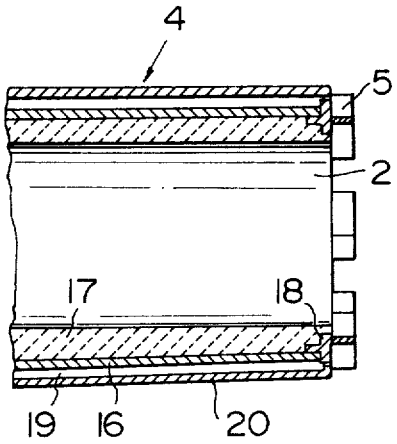
FIG. 2 is a fragmentary sectional view showing the outlet portion of the rotary kiln.
Figure 3:
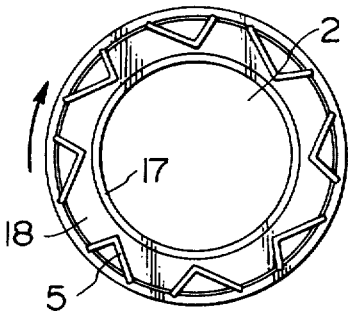
FIG. 3 is an end view of the rotary kiln shown in FIG. 2.

According to the feature of the present invention, the kiln 1 is provided at the outlet end 2 with distribution members 5. Referring specifically to FIGS. 2 and 3, the kiln body 4 is comprised of an inner cylinder 16, an inner brick liner 17 which is maintained on the cylinder 16 against axial movement by means of a retaining member 18, and an outer cylinder 20 coaxially encircling the inner cylinder 16 with an annular space 19 therebetween. A plurality of distribution members 5 are secured to the retaining member 18 at circumferentially spaced positions.

Figure 4:
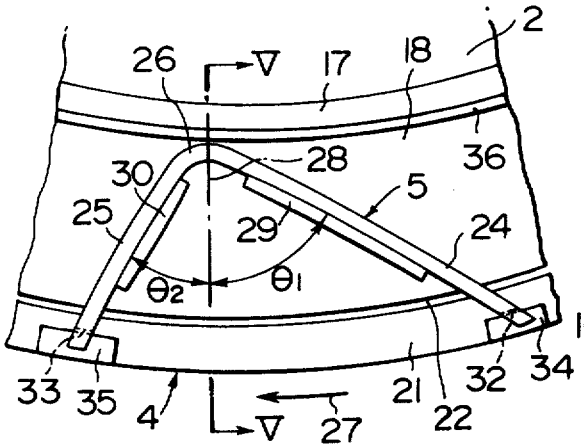
FIG. 4 is an enlarged fragmentary end view showing an example of the distribution member in accordance with the present invention.
Figure 5:
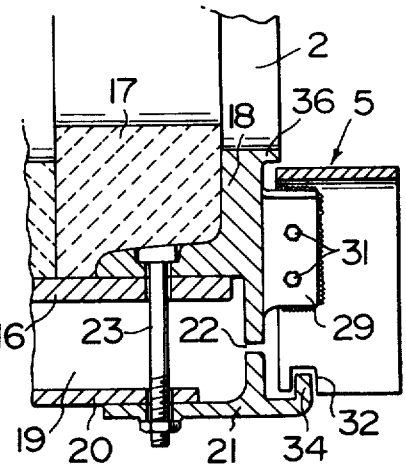
FIG. 5 is a sectional view taken substantially along the line V—V in FIG. 4.

Referring to FIGS. 4 and 5, it will be noted that the retaining member 18 has a radially inwardly extending flange portion which engages the axial end of the brick liner 17 to hold the liner against axial movement and a radially outwardly extending flange portion which extends to the midway of the space 19. The outer cylinder 20 carries an annular cover 21 which has a radially inwardly directed flange portion adapted to be opposed to the outwardly extending flange portion to define an annular air outlet 22 therebetween. The retaining member 18 and the cover member 21 are secured to the kiln body 4 by means of bolts 23.

The distribution member 5 is made of an angled heat resistant cast steel material of substantially L-shaped cross-sectional configuraton having a longer side 24 and a shorter side 25 which are continued with each other at an angled edge 26. The member 5 is positioned with the angled edge 26 directed radially inwardly and extends in the longitudinal direction of the kiln body 4 outwardly beyond the outlet end 2 of the body 4. In the illustrated preferable arrangement, as seen in the direction of the rotation of the kiln 1 which is shown by an arrow 27, the longer side 24 is located at the trailing side whereas the shorter side 25 at the leading side with respect to a radial line 28 passing through the angled edge 26. The radial line 28 defines angles $\theta_1$ and $\theta_2$ with the longer and shorter sides 24 and 25, respectively, the angle $\theta_1$ being larger than the angle $\theta_2$. The inventors have found that a satisfactory result can be obtained with the angle $\theta_1$ of 60° to 80° and the angle $\theta_2$ of 0° to 20°.

In order to secure the distribution member 5 to the retaining member 18, the latter is provided with brackets 29 and 30. The member 5 is held on the brackets 29 and 30 by fixing the sides 24 and 25 respectively to the brackets 29 and 30 by means of bolts 31 and thereafter welding the sides to the corresponding brackets. The sides 24 and 25 are respectively formed at their free ends with cutouts 32 and 33 which are adapted to engage with lugs 34 and 35 formed on the cover member 21. The retaining member 18 is formed at the radially inward portion with an axially outwardly extending projection 36 which overhangs the distribution members 5 so that the clinker particles are guided to the members 5 when they are discharged through the outlet end 2 of the kiln 1.

Figure 6:
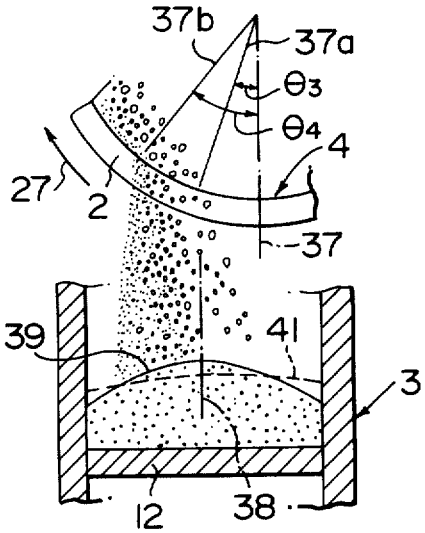
FIG. 6 is an end view showing the discharge of cement clinker in a conventional burning apparatus.

In operation, when the burned clinker particles are discharged through the outlet of the kiln 1, there is a tendency that the particles are concentrated at the downstream side as seen in the direction of the rotation of the kiln 1. Where the kiln 1 is not provided with the aforementioned distribution members, the particles are discharged through an angular range defined by radial lines 37*a* and 37*b* which are offset toward downstream side from a vertical radial line by angles $\theta_3$ and $\theta_4$, respectively, as shown in FIG. 6. There is further a tendency that large particles are concentrated at the upstream side whereas fine particles at the downstream side. In usual arrangement, the angle $\theta_3$ is approximately 20° and the angle $\theta_4$ approximately 40°.

Taking the above tendencies into consideration, the cooling section 3 is normally offset with respect to the vertical line 37 transversely in the direction of rotation of the kiln 1 as shown in FIG. 6. Thus, the clinker particles are discharged onto the transverse central portion of the grate structure 12 to be accumulated thereon as shown by 39 in FIG. 6.

Figure 7:
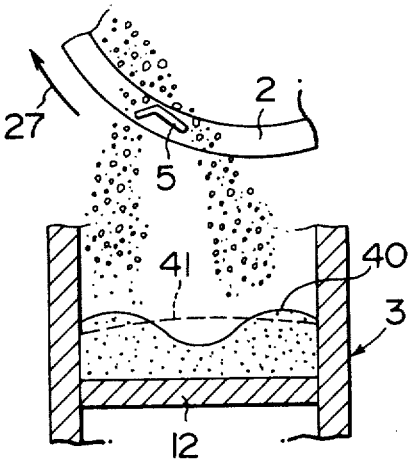
FIG. 7 is an end view similar to FIG. 6 but showing the function of the distribution member in accordance with the present invention.

FIG. 7 shows the function of the distribution member 5. It will be understood in FIG. 7 that, when the member 5 passes through the angular range as defined by the radial lines 37*a* and 38*b*, the clinker particles are deflected toward the transversely outside directions of the grate structure 12. When the member 5 is at the upstream or trailing portion of the angular range, that is, the portion nearer to the line 37*a*, the clinker particles are mostly engaged with the shorter side 25 of the member 5 so that they are deflected toward the downstream or leading side irrespective of the particle size. As the kiln 1 rotates, the member 5 is moved to the downstream or leading portion of the angular range, that is, the portion nearer to the line 37*b*. The clinker particles are then engaged with the longer size 24 to be deflected toward the upstream or trailing side. Thus, as the distribution member 5 passes through the aforementioned angular range, the clinker particles are accumulated to form a bed on the grate structure with a uniform particle distribution and greater bed thickness at each side portion than in the central portion as shown by 40 in FIG. 7.

Since the distribution members 5 are provided at circumferentially spaced positions, the clinker particles are accumulated at the central portion of the grate structure 12. As the result, as soon as the clinker particles are transported on the grate structure 12 by a short distance, the bed thickness of the particles are substantially uniformized as shown by 41 in FIG. 7. The particle bed thus formed is significant in that it has a substantially uniform particle distribution. The annular space 19 is supplied with cooling air which is discharged through the air outlet 22 to provide a cooling effect to the distribution members 5. Thus, the members 5 are prevented from overheating.

Figure 8:
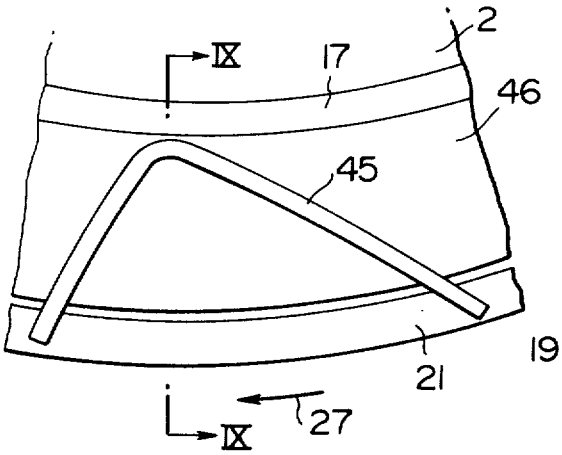
FIG. 8 is a view similar to FIG. 4 but showing another embodiment of the present invention.
Figure 9:
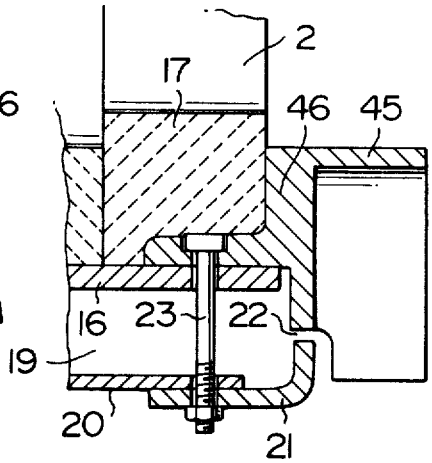
FIG. 9 is a sectional view taken substantially along the line IX—IX in FIG. 8.

Referring now to FIGS. 8 and 9 which show another embodiment of the present invention, the inner cylinder 16 of the kiln body has a ring-shaped retaining member 46 which is secured thereto by bolts 23 for axially holding the brick lining 17. The retaining member 46 has a plurality of distribution members 45 which are casted integrally with the retaining member 46 at circumferentially spaced positions so as to extend axially outwardly. The configuration of the distribution member 45 is substantially the same as the member 5 in the previous embodiment.

Figure 10:
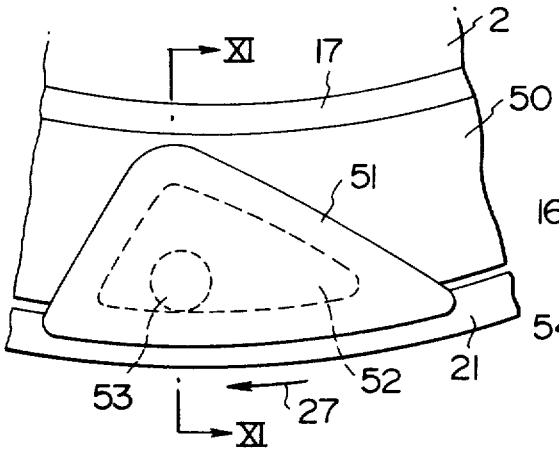
FIG. 10 is a fragmentary end view of a rotary kiln showing a further embodiment of the present invention.
Figure 11:
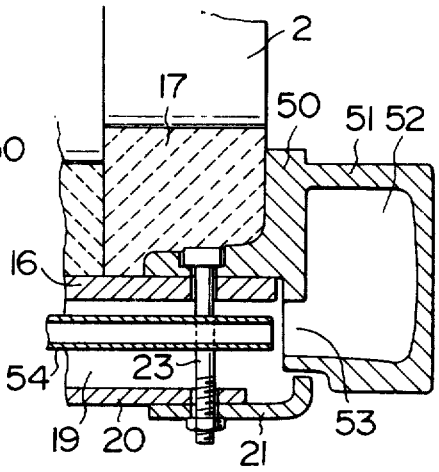
FIG. 11 is a sectional view taken substantially along the line XI—XI in FIG. 10.

FIGS. 10 and 11 show a further embodiment of the present invention. In this embodiment, an annular brick retaining member 50 is secured to the inner cylinder 16 by means of bolts 23 for axially holding the brick lining 17. The member 50 has a plurality of hollow block portions 51 which is of substantially triangular cross-section and casted integrally with the member 50 so as to extend axially therefrom. The block portion has a hollow interior 52 which is opened through a port 53 toward the annular space 19. In the space 19, there is provided a cooling air pipe 54 for directing cooling air into the interior 52 of the block portion 51.

Figure 12:
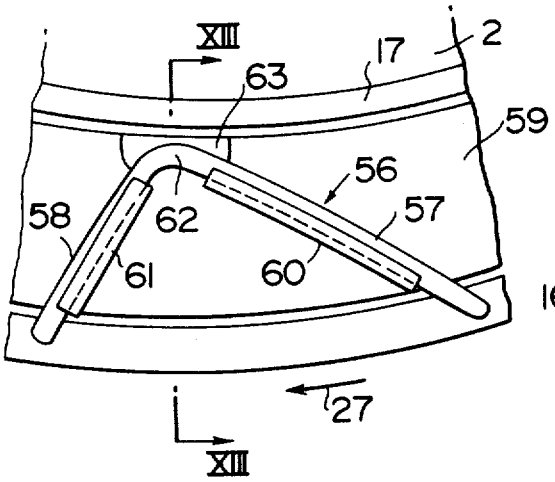
FIG. 12 is an end view similar to FIG. 10 but showing still further embodiment of the present invention.
Figure 13:
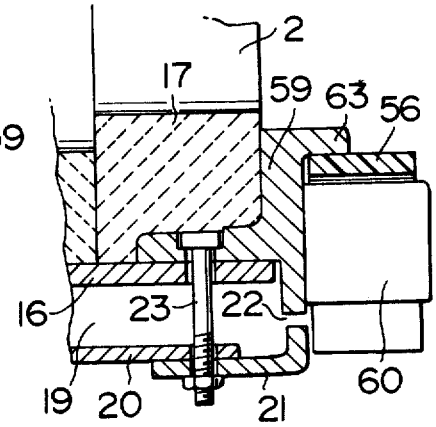
FIG. 13 is a sectional view taken substantially along the line XIII—XIII in FIG. 12.

Referring further to FIGS. 12 and 13, the embodiment shown therein has distribution members 56 which are of angled shape and made of a ceramic material. At the outlet end 2 of the kiln 1, the inner cylinder 16 has an annular retaining member 59 which is secured thereto by bolts 23. Each of the members 56 is carried on the retaining member 59 by engaging the longer and shorter sides 57 and 58 with brackets 60 and 61, and the angled edge 62 with a bracket 63, the brackets 60, 61 and 63 being integrally formed with the retaining member 59.

Figure 14:
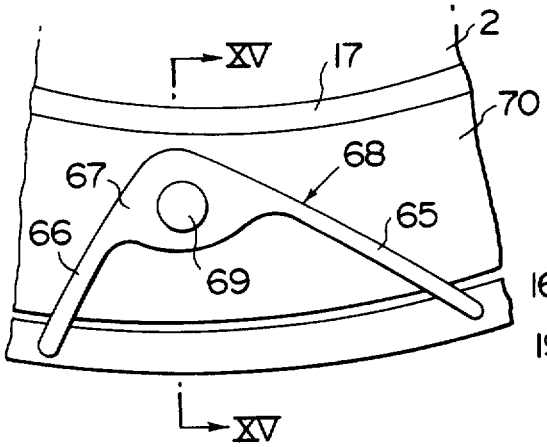
FIG. 14 is an end view similar to FIG. 10 but showing a further emboidment of the present invention.
Figure 15:
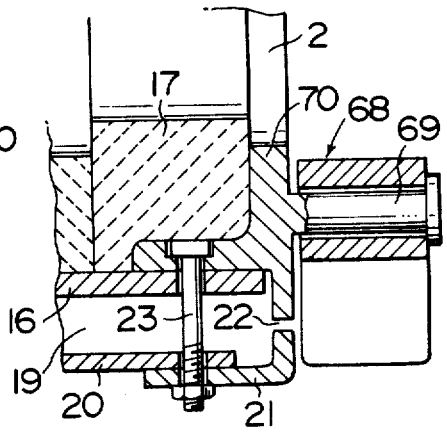
FIG. 15 is a sectional view taken substantially along the line XV—XV in FIG. 14.

Referring now to FIGS. 14 and 15, the embodiment shown therein has an annular retaining member 70 secured to the inner cylinder 16 for holding the brick lining 17 as discussed with reference to the previous embodiments. The member 70 has a plurality of axially extending pins 69 for mounting distribution members 68. As shown in FIG. 14, the distribution member 68 has longer and shorter sides 65 and 66 which are joined together through a corner portion 67. The pin 69 extends through the member 68 at the corner portion 67 so that the member 68 is swingable about the pin 69. The arrangement is advantageous in that the shock load applied by the clinker particle to the member 68 can be decreased through swingable movement of the member 68 and wear of the member 68 can therefore be minimized.

Figure 16:
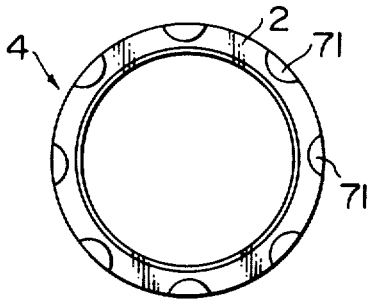
FIGS. 16 and 17 are end views showing further embodiments of the present invention.

FIG. 16 shows a further embodiment of the present invention. In this embodiment, the kiln body 4 is provided at the outlet end 2 with a plurality of circumferentially spaced semi-cylindrical distribution members 71 which may be made either of heat resistant cast steel or of ceramic material. As shown in FIG. 16, the members 71 are disposed with the part-cylindrical surface directed toward the radially inwardly of the body 4.

Figure 17:
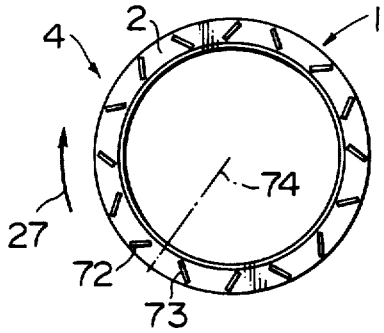

Referring to FIG. 17, the distribution device is comprised of deflecting plates 72 and 73 which are made of heat resistant cast steel and inclined with respect to radial lines passing between each two adjacent plates in alternate directions. Referring to a specific radial line 74, the plate 72 is inclined toward the downstream or leading side as it goes radially outwardly whereas the plate 73 is inclined in the opposite direction.

Figure 18:
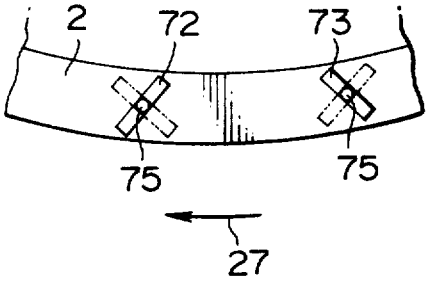
FIG. 18 is a fragmentary end view showing a still further embodiment of the present invention.
Figure 19:
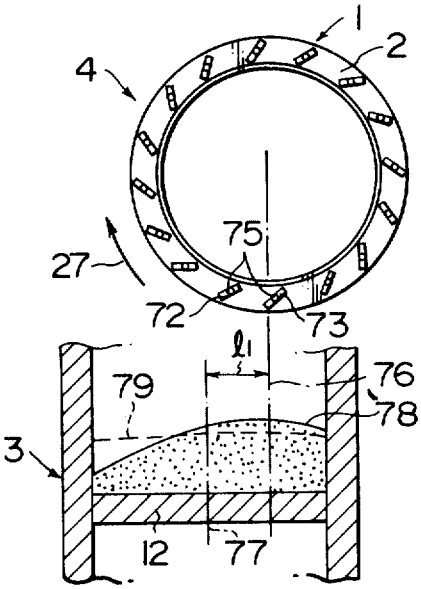
FIGS. 19 and 20 show relationship between the distribution for the powder material and the offset of the longitudinal center axis of the rotary kiln from that of the grate.

The deflecting plates 72 and 73 may be mounted on the kiln body through axially extending pins 75 in such a manner that the inclination angles of the plates 72 and 73 can be adjusted as desired as shown by phantom lines in FIG. 18. Any conventional mechanism, such as wing nuts threadedly engaged with ends of pins 75, can be used to maintain desired inclination angles of the plates 72 and 73. The arrangement is advantageous in that the inclination angles of the plates 72 and 73 can be adjusted taking reference to the distance of transverse offset between the center of the rotary kiln and the center of the grate structure. Referring for example to FIG. 19, where the offset distance $l_1$ between the vertical radial line 76 of the kiln 1 is larger than an optimum value, there is a tendency that the clinker particles are concentrated to the side of the grate structure 12 opposite to the direction of rotation of the kiln 1 as shown by 78 in FIG. 19. In the instance, the plates 72 and 73 may both be inclined in such a manner that their radially outward ends are at the downstream or leading side with respect to the inward ends as seen in the direction of rotation of the kiln 1. The clinker particles may then be deflected toward the leading side so that uniform distribution of the particles can be established as shown by 79 in FIG. 19.

Figure 20:
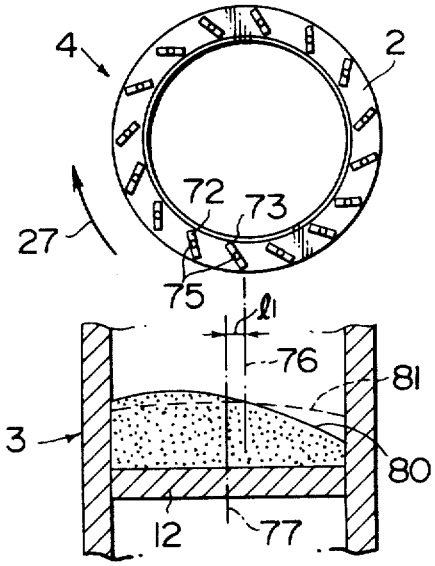

When the offset distance $l_1$ is too small as compared with the optimum value, the clinker particles are apt to be concentrated at the leading side of the grate structure as shown by 80 in FIG. 20. In such a case, the plates 72 and 73 may be adjusted in the direction opposite to that in FIG. 19 so that the particle bed thickness is uniformized as shown by 81 in FIG. 20.

The invention has thus been shown and described with reference to specific embodiments, however, it should be noted that the invention is in no way limited to the details of the illustrated structures but changes and modifications may be made without departing from the scope of the appended claims. For example, where the distribution members are made of cast steel material, they may be coated with ceramics. Further, although the invention has been described with reference to rotary kiln type cement clinker burning apparatus, it may be applied to other rotary drum apparatus such as rotary drum type dryers.

We claim:

1. Rotary drum type heat treatment apparatus comprising a rotary drum rotatable about a longitudinal axis and having an outlet end and a cooling section including grate means having one end disposed beneath the outlet end of the rotary drum for receiving material from the drum, said drum being provided at the outlet end with a plurality of circumferentially spaced distribution members, each of said distribution members having at least one side surface which is extending longitudinally outwardly beyond the outlet end and inclined with respect to a radial line of the drum for engagement with the material being discharged through the outlet end to deflect the same, said side surface being provided by a plate which is mounted on the drum for angular adjustment about an axis parallel with the longitudinal axis of the drum.

2. Rotary drum type heat treatment apparatus comprising a rotary drum rotatable about a longitudinal axis and having an outlet end and a cooling section including grate means having one end disposed beneath the outlet end of the rotary drum for receiving material from the drum, said drum being provided at the outlet end with a plurality of circumferentially spaced distribution members, each of said distribution members having at least one side surface which is extending longitudinally outwardly beyond the outlet end and inclined with respect to a radial line of the drum for engagement with the material being discharged through the outlet end to deflect the same, and each of said distribution members having at least a pair of side surfaces disposed at the opposite sides of a radial plane of the drum and extending longitudinally outwardly beyond the outlet end for engagement with the material being discharged through the outlet for deflecting the material toward side portions of the grate means.

3. The apparatus in accordance with claim 2 in which the distribution member has a crest defined by a junction of the side surfaces and located radially inwardly of the drum with respect to the side surfaces, said side surfaces being inclined with respect to a radial plane of the drum passing through the crest to define angles therewith.

4. The apparatus in accordance with claim 3 in which the angle as defined by one of the side surfaces that is located leading side of the radial plane in the direction of rotation of the drum is smaller than that defined by the other side surface.

5. The apparatus in accordance with claim 3 in which said distribution member is mounted at the crest for swinging movement about an axis parallel with the longitudinal axis of the drum.

6. Apparatus in accordance with claim 1 in which means is provided for supplying cooling air to the distribution members.

7. Apparatus in accordance with claim 2 in which said pair of side surfaces are provided by a pair of plates which are inclined in opposite directions with respect to a radial plane of the drum passing between the plates.

* * * * *